United States Patent [19]

Takahashi

[11] Patent Number: 4,903,081

[45] Date of Patent: Feb. 20, 1990

[54] TRANSFER DEVICE

[75] Inventor: Michio Takahashi, Machida, Japan

[73] Assignee: Ricoh Company, Ltd., Tokyo, Japan

[21] Appl. No.: 280,713

[22] Filed: Dec. 6, 1988

[30] Foreign Application Priority Data

Dec. 7, 1987 [JP] Japan ..... 62-307743

[51] Int. Cl.[4] ..... G03G 15/16; G03G 15/14

[52] U.S. Cl. ..... 355/274; 355/276

[58] Field of Search ..... 355/210, 271, 273, 274, 355/275, 276

[56] References Cited

U.S. PATENT DOCUMENTS 3,847,478 11/1974 Young ..... 355/274

4,415,256 11/1983 Inoue et al. ..... 355/274

FOREIGN PATENT DOCUMENTS 0102278 6/1983 Japan ..... 355/274

*Primary Examiner*—A. T. Grimley

*Assistant Examiner*—William Royer

*Attorney, Agent, or Firm*—Oblon, Spivak, McClelland, Maier & Neustadt

[57] ABSTRACT

A transfer device is provided with a cleaning unit having a magnetic brush roller and functions to electrostatically transfer a toner image on an image carrier to a transfer material held on a dielectric body. The device has a transfer charger for applying DC electric field to the portion of the dielectric body opposite to the image carrier during transfer so that the toner image on the image carrier is transferred to the transfer material. The device also has means for applying AC voltage to the transfer charger within a given time during non-transfer, and a DC charger for applying DC electric field with the same polarity as that of the toner particles frictionally electrified to the surface of the dielectric body at least within a given time.

8 Claims, 2 Drawing Sheets

TRANSFER DEVICE

BACKGROUND OF THE INVENTION

The present invention relates to a transfer device which is provided with a cleaning unit having a magnetic brush roller and which functions to electrostatically transfer a toner image on an image carrier to a transfer material held on a dielectric body.

Transfer devices such as electrophotographic copying machines are generally provided with cleaning units for removing the toner particles that remain on an image carrier comprising, for example, a photosensitive body, after transfer operation. One of the methods of removing remaining toner particles is a magnetic brush cleaning method in which a magnetic brush is formed by carrier particles magnetized by magnetic field formed by a magnet contained within a sleeve so that the toner particles are removed and recovered by the rotating magnetic brush. In this case, the carrier particles are formed by a material which is frictionally electrified to have the polarity reverse to that of the toner, and a bias voltage with the polarity reverse to that of the toner is applied to the sleeve.

For some reason, however, the remaining toner particles contain toner particles which are electrified to have the polarity reverse to the initial polarity. Such toner particles having the reverse polarity cannot be easily removed to an adequate extent by the magnetic brush cleaning method. In order to increase the cleaning performance, the polarity of the toner particles on a photosensitive body is made uniform with the initial polarity of the toner before cleaning by a discharger. If discharge is performed by applying a high potential for the purpose of making the polarity uniform, however, the photosensitive body and the toner particles become strongly electrified, leading to a deterioration in the cleaning performance. The voltage applied by the discharger before cleaning cannot be high and thus the toner particles having the reverse polarity cannot be easily removed to an adequate extent.

It has therefore been thought that a rubber blade could be pressed against the surface of the photosensitive body so that the reversely electrified toner particles are completely removed by mechanical force. This blade cleaning, however, has the disadvantage that damage of the surface of the photosensitive body may readily occur, resulting in deterioration of the quality of an image. The positional relationship between the photosensitive body and the blade is also limited. If an inappropriate positional relationship is established, the toner particles removed by the blade cannot be easily recovered, with the result that certain restrictions on layout are imposed. For example, if the blade is disposed just above the photosensitive body for cleaning off the toner particles, the toner particles cannot be easily recovered.

SUMMARY OF THE INVENTION

It is therefore an object of the present invention to provide a transfer device which is arranged to perform cleaning by using a magnetic brush cleaning method and which is significantly improved in terms of its ability to clean off reversely electrified toner particles.

In order to achieve the above-described object the present invention provides a transfer device which is provided with a cleaning unit having a magnetic brush roller and which functions to electrostatically transfer a toner image on an image carrier to a transfer material held on a dielectric body. The device comprises a transfer charger which serves to apply DC electrical field to the dielectric body during transfer so that the toner image on the image carrier is transferred to the transfer material; means for applying AC voltage to the transfer charger within a given period during non-transfer; and a DC charger for applying DC electrical field with the same polarity as that of the toner particles produced by frictional electrification, at least within the given period.

In the present invention, therefore, the polarity of the charged toner particles is made uniform by a cleaning method that utilizes a magnetic brush roller so that an attempt can be made to improve the performance of cleaning of the image carrier.

Further objects and advantages of the present invention will be apparent from the following description, reference being made to the accompanying drawings wherein preferred embodiments of the present invention are clearly shown.

DESCRIPTION OF THE PREFERRED EMBODIMENTS

Figure 1:
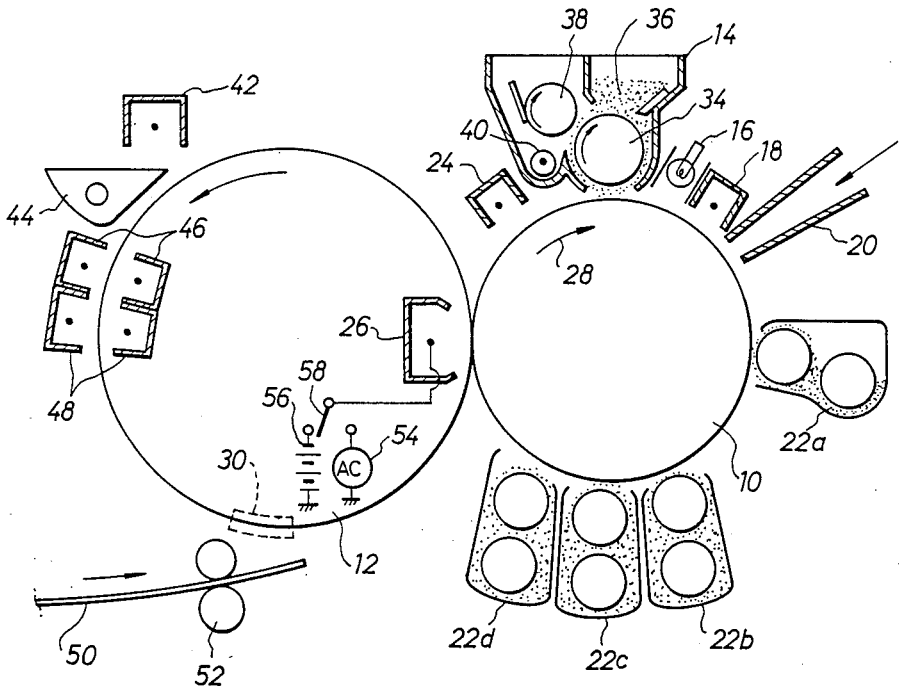
FIG. 1 a schematically sectional view of a part of an electrophotographic copying machine of an embodiment of the present invention.
Figure 2:
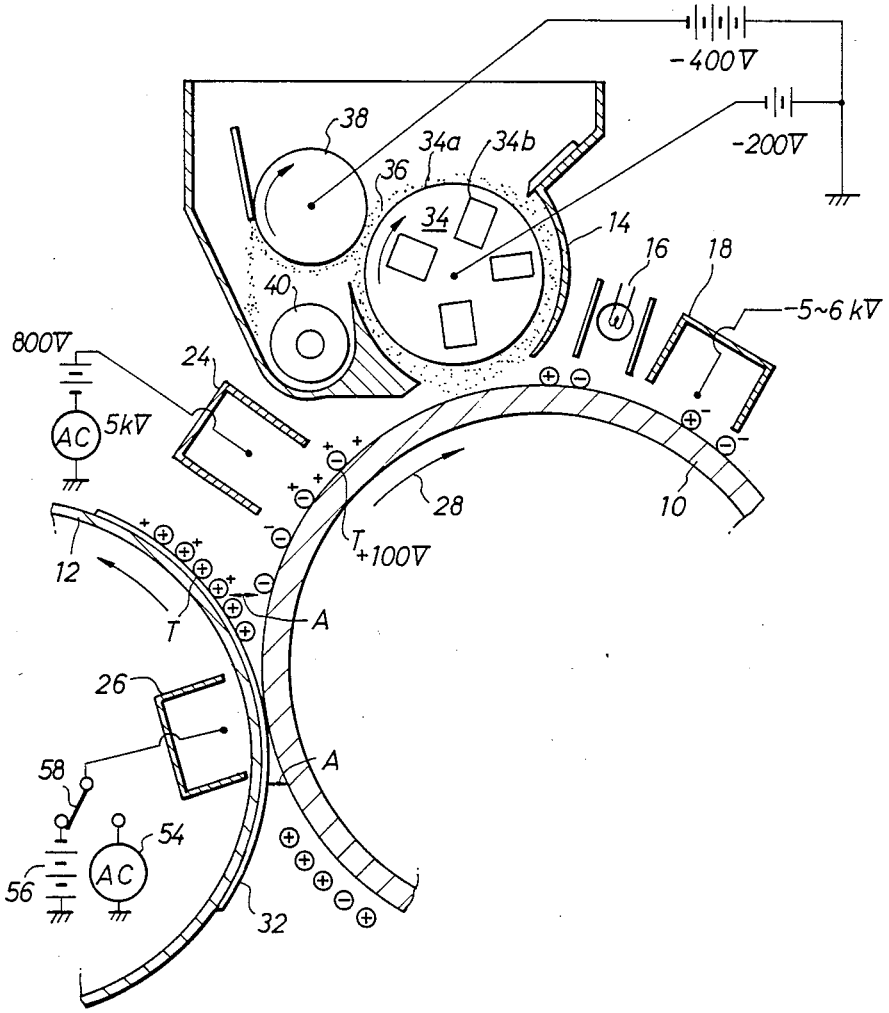
FIG. 2 is a detailed sectional view of a part of the machine shown in FIG. 1.

In FIGS. 1 and 2, reference numeral 10 denotes a photosensitive drum. A transfer drum 12 of dielectric member and a cleaning unit 14 employing a magnetic brush cleaning method are disposed opposite to the photosensitive drum 10. Around the photosensitive drum 10, are disposed a discharge light source 16 for removing charge remaining on the photosensitive drum 10, an electrification charger 18 for uniform electrification, an exposure unit 20 for creating a latent image, development units 22*a*, 22*b*, 22*c* and 22*d* for respective colors which respectively cause a toner of the corresponding color to adhere to the latent image created to form a toner image, and a discharger 24 for discharging electrification before cleaning. A transfer charger 26 is also provided in the transfer drum 12 so as to oppose the photosensitive drum 10.

When the photosensitive drum 10 is rotated in the direction shown by the arrow 28, removal of remaining charge (the discharge light source 16), electrification at −5 to 6 kV (electrification charger 18), creation of the latent image by exposure (exposure unit 20) and formation of the toner image (development unit 22*a*, 22*b*, 22*c* or 22*d*) are performed, and a toner image of the color corresponding to the latent image is transferred to a transfer paper 32 (FIG. 2) which is held on the transfer drum 12 by means of a clamp unit 30. A toner image of one color is transferred during one rotation of the photosensitive drum 10, this operation being repeated so as to transfer images of the necessary colors in layers to obtain a color image.

The cleaning unit 14 comprises a magnetic brush roller 34 which is formed by disposing a magnet 34*b* in a sleeve 34*a*, carrier particles 36 made of a magnetic substance which are magnetized by the magnet 34*b*, a recovery roller 38 for recovering toner particles and an exhaust screw 40 for expelling recovered toner particles. DC bias voltages of −200 V and −400 V are applied to the magnetic brush roller 34 and the recovery roller 38, respectively. The carrier particles 36 are the same as those contained in the development units. In the cleaning unit 14, the toner particles are also mixed with the carrier particles 36 for the purpose of reducing the abrasion of the carrier particles 36 and keeping them for a long time. The toner particles are formed by a material frictionally electrified to have a positive polarity, and the carrier particles 36 are formed of a material frictionally electrified to have the reverse polarity against that of the toner particles, namely negative.

The discharger 24 for discharging electrification of the photosensitive drum 10 before cleaning is interposed between the transfer drum 12 and the cleaning unit 14 so as to oppose the photosensitive drum 10, a DC voltage of 800 V and an AC voltage of 5 kV being applied to the discharger 24 in such a manner that one is superposed on the other. This discharging functions to remove the electrostatic potential of the latent image formed on the photosensitive drum 10.

Around the transfer drum 12 are provided a separation discharger 42 which is operated during separation of the transfer paper 32 and a separating claw 44, as well as a discharger 46 and a pre-electrification charger 48. In FIG. 1, reference numeral 50 denotes a transfer paper and reference numeral 52 denotes two resist rollers for conveying the transfer paper 50.

An alternating current (AC) bias means 54 and a direct current (DC) bias means 56 can be selectively connected to the transfer charger 26 through a switch 58. The switch 58 is switched to the side of the AC bias means 54 within a given period during non-transfer so that an AC bias voltage is applied to the transfer charger 26 which thus produces alternating current (AC) corona discharge. The switch 59 is switched to the side of the DC bias means 56 during transfer so that a DC bias voltage is applied to the transfer charger 26 which thus produces direct current (DC) corona discharge. In this case, a direct current (DC) electrical field with the polarity reverse to the polarity of the toner particles, i.e., negative in this embodiment, is applied to the transfer drum 12.

Description will now be given to the transfer operation of the transfer device and the cleaning operation thereof.

A latent image formed by exposure on the photosensitive drum 10 is developed by one of the development units 22*a*, 22*b*, 22*c* and 22*d*. As a result, a toner image of one color is formed on the photosensitive drum 10. In this case, since a DC voltage with a negative polarity is applied to the transfer charger 26 of the transfer drum 12 from the DC bias means 56 through the switch 58, the toner particles electrified to positive on the photosensitive drum 10 are transferred to the transfer paper on the transfer drum 12. The toner particles remaining on the photosensitive drum 12 after transfer operation are cleaned off by the cleaning unit 14. In this case, the force for cleaning the toner particles off the surface of the photosensitive drum 10 comprises a field attraction force based on the bias voltage applied to the sleeve 34, a scraping force produced by the magnetic brush roller 34 and a static attraction force produced by the frictional electrification of the carrier particles.

The electrification (charging), exposure, development, transfer and cleaning are then performed for the next color. These operations are repeated for each of the relevant colors so that the colors are transferred in layers to obtain a color image.

During the above-described transfer operation, the AC bias voltage is applied to the discharger 46 so that electrification of the transfer drum 12 is discharged. The DC positive bias voltage and negative bias voltage are also applied to the outer pre-electrification charger 48 and the inner pre-electrification charger 48, respectively, so that positive corona discharge takes place on the outside of the transfer drum 12 and negative corona discharge takes place inside it.

When series of transfer cycles are completed to obtain a color image, the transfer paper is separated from the transfer drum 12 by the operation of the separation discharger 42 and the separation claw 44 and is then moved to the next fixing process. After the transfer paper has been separated, the separation discharger 42 is turned off, and the switch 58 is switched to the side of the AC bias means 54 so that the AC bias voltage is applied to the transfer charger 26, with AC corona discharge taking place. In this case, a voltage may or may not be applied to the discharger 46, and the DC bias voltage is applied to the pre-electrification chargers 48 in the same way as in the transfer operation. In other words, setting is so performed that DC positive corona discharge takes place on the outside of the transfer drum 12 and DC negative corona discharge takes place inside it. When the photosensitive drum 10 and the transfer drum 12 are rotated for a given time in the above-described state, the toner particles which are present on the photosensitive drum 10 and which are for some reason reversely electrified are re-electrified to take a positive polarity. Such reverse electrification is caused by, for example, electrification by the electrification charger 14 of toner particles T which have not been cleaned off by the cleaning unit 14 or exposure of the toner particles T to aerial discharge produced in a region A where the photosensitive drum 10 is adjacent to the transfer drum 12.

The toner particles which adhere to the photosensitive drum 10 and which are reversely electrified (negative) and cannot easily be removed by the magnetic brush roller 34 are transferred to the transfer drum 12 by the transfer charger 26 which is subjected to AC corona discharge and are electrified by the pre-electrification chargers 48 to have a positive polarity. After the polarity of the toner particles has been made uniform with a positive polarity, they are reversely transferred from the transfer drum 12 to the photosensitive drum 10 having the surface which is electrified to have a negative polarity. As a result, the polarity of the toner particles on the photosensitive drum 10 is made uniform with a positive polarity and can thus be easily and surely cleaned off by the magnetic brush roller 34.

The AC voltage is applied to the transfer charger 26 by reason that the negative toner particles reversely electrified are transferred from the photosensitive drum 10 to the transfer drum 12 at the same time as the toner particles which are over again electrified to have a positive polarity are reversely transferred on the photosensitive drum 10 from the transfer drum 10. In this case, the frequency of the AC bias voltage is 200 Hz to 1 kHz, and the voltage is within the range of 4 to 7 kV.

The polarity of the toner particles can also be made uniform by changing the transfer charger 26 to positive relative to the reversely electrified toner particles on the photosensitive drum 10, as well as maintaining the state of the DC pre-electrification chargers 48 (positive on the outside thereof and negative inside it so that the toner particles are electrified to positive) of the transfer drum 12, so that the transfer charger 26 causes an attraction force to act on the reversely electrified toner particles on the photosensitive drum 12 and a repulsive force to act on the electrified toner particles with a positive polarity on the transfer drum 12. In regard to the transfer polarity, however, the use of an alternating current enables both the transfer to the transfer drum 12 and the reverse transfer therefrom to be effected with a good efficiency, with good results being obtained. It is thought that this is because an alternating current (AC) applies an attraction force and a repulsive force to the toner particles by an electrical field and a vibrational force to the toner particles and is thus effective to reduce the physical adhesion of the toner particles to the photosensitive drum 10 and the transfer drum 12.

The use of such corona discharge exhibits a good efficiency even if the gap in the contact portion between the photosensitive drum 10 and the transfer drum 12 is zero or they are no brought into contact with each other and thus has the advantage that a margin of the gap is increased.

Although the above-described embodiment uses the toner particles which are frictionally electrified to have a positive polarity, the transfer device of the present invention may use toner particles which are frictionally electrified to have a negative polarity. In such a case, the polarity of the bias voltage is reverse to that in the above-described embodiment.

Many widely different embodiments of the present invention may be constructed without departing from the spirit and scope of the present invention. It should be understood that the present invention is not limited to the specific embodiments described in this specification, except as defined in the appended claims.

What is claimed is:

1. A transfer device provided with a cleaning unit having a magnetic brush roller, for functioning to electrostatically transfer a toner image on an image carrier to a transfer material held on a dielectric body, said device comprising:

a transfer charger for applying DC electric field to the portion of said dielectric body opposite to said image carrier during transfer so that said toner image on said image carrier is transferred to said transfer material;

means for applying AC voltage to said transfer charger within a given time during non-transfer; and a DC charger for applying DC electric field with the same polarity as that of the toner particles frictionally electrified to the surface of said dielectric body at least within said given time.

2. A device according to claim 1, wherein said means for applying AC voltage includes means for selectively applying AC voltage to said transfer charger within said given time during non-transfer.

3. A device according to claim 2, wherein said means for applying AC voltage comprises AC bias means for generating AC voltage, and switch means for selectively connecting said AC bias means to said transfer charger within said given time during non-transfer.

4. A device according to claim 3, wherein said AC bias means includes means for generating AC voltage with frequency of 200 Hz to 1 kHz.

5. A device according to claim 3, wherein said AC bias means includes means for generating AC voltage of 4 to 7 kV.

6. A device according to claim 1, wherein said image carrier is a photosensitive drum and said dielectric body is a dielectric transfer drum which partially opposes said photosensitive drum.

7. A device according to claim 6, wherein said transfer charger is disposed in said transfer drum so as to oppose said photosensitive drum.

8. A device according to claim 6, wherein said DC charger is a charger for applying DC electric field with the same polarity as that of the toner particles frictionally electrified by to the external surface of said transfer drum.

* * * * *